US008471796B2

(12) United States Patent
Kwon et al.

(10) Patent No.: US 8,471,796 B2
(45) Date of Patent: Jun. 25, 2013

(54) APPARATUS FOR PROVIDING GRAYSCALE VOLTAGES AND DISPLAY DEVICE USING THE SAME

(75) Inventors: Kyu-Min Kwon, Asan-si (KR); Ho-Sup Choi, Seoul (KR); Sang-Youn Kim, Cheonan-si (KR); Byoung-Haw Park, Cheonan-si (KR); Cheal-Gi Kim, Yongin-si (KR); Heung-Sik Tae, Incheun (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 938 days.

(21) Appl. No.: 12/429,875

(22) Filed: Apr. 24, 2009

(65) Prior Publication Data

US 2010/0123653 A1 May 20, 2010

(30) Foreign Application Priority Data

Nov. 18, 2008 (KR) ..... 10-2008-0114775

(51) Int. Cl.
*G09G 3/36* (2006.01)

(52) U.S. Cl.
USPC ..... 345/89; 345/690

(58) Field of Classification Search
USPC ..... 345/89, 98–100, 204, 690
See application file for complete search history.

(56) References Cited

U.S. PATENT DOCUMENTS

| | | | | |
|---|---|---|---|---|
| 5,414,443 | A * | 5/1995 | Kanatani et al. | 345/95 |
| 2003/0151577 | A1* | 8/2003 | Morita | 345/89 |
| 2004/0160402 | A1* | 8/2004 | Kim et al. | 345/89 |
| 2005/0219935 | A1* | 10/2005 | Watanabe et al. | 365/230.06 |
| 2007/0176879 | A1* | 8/2007 | Makino et al. | 345/98 |
| 2009/0135116 | A1* | 5/2009 | Chang | 345/87 |

* cited by examiner

*Primary Examiner* — Amare Mengistu
*Assistant Examiner* — Shawna Stepp Jones
(74) *Attorney, Agent, or Firm* — F. Chau & Associates, LLC

(57) ABSTRACT

An apparatus for providing grayscale voltages and a display device using the same are provided. The display device includes a grayscale voltage provider that provides grayscale voltages using a first reference voltage and a second reference voltage in accordance with a selection signal. A data driver applies data voltages to data lines using the grayscale voltages and an image signal. A gate driver successively provides a gate-on voltage to the gate lines. A display panel displays an image for each frame using the data voltages and the gate-on voltage.

18 Claims, 11 Drawing Sheets

APPARATUS FOR PROVIDING GRAYSCALE VOLTAGES AND DISPLAY DEVICE USING THE SAME

CROSS-REFERENCE TO RELATED APPLICATION

This application claims priority to and the benefit of Korean Patent Application No. 10-2008-0114775, filed on Nov. 18, 2008 in the Korean Intellectual Property Office, the entire content of which is incorporated herein by reference.

BACKGROUND OF THE INVENTION

1. Field of the Invention

The present disclosure relates to an apparatus for providing grayscale voltages and a display device using the same.

2. Discussion of the Related Art

A liquid crystal display (LCD) includes a first substrate having pixel electrodes, a second substrate having common electrode, a liquid crystal layer having dielectric anisotropy and injected between the first substrate and the second substrate, a gate driver driving a plurality of gate lines, a data driver providing data voltages, and a grayscale voltage provider providing a plurality of grayscale voltages.

The grayscale voltage provider divides a reference voltage of a specified voltage level into a plurality of grayscale voltages, and provides the divided grayscale voltages to the data driver. The data driver may apply the grayscale voltages provided from the grayscale voltage provider to pixels as they are, or subdivide the grayscale voltages through voltage division to apply the subdivided grayscale voltages to the pixels.

SUMMARY OF THE INVENTION

In accordance with the embodiments of the present invention a display device is provided that can reduce the inferiority of picture quality.

In accordance with the embodiments of the present invention an apparatus provides grayscale voltages that can reduce picture quality inferiority.

A display device, according to exemplary embodiments of the present invention, includes a grayscale voltage provider that provides grayscale voltages using a first reference voltage and a second reference voltage in accordance with a selection signal. A data driver applies data voltages to data lines using the grayscale voltages and an image signal. A gate driver successively provides a gate-on voltage to the gate lines. A display panel displays an image for each frame using the data voltages and the gate-on voltage.

In accordance with an exemplary embodiment of the present invention, an apparatus for providing grayscale voltages is provided, which includes a reference voltage selector having a first node to which a first reference voltage is applied and a second node to which a second reference voltage that has a voltage level different from that of the first reference voltage, is applied, and which outputs the first reference voltage or the second reference voltage as a reference voltage in accordance with a selection signal. A grayscale voltage generator generates grayscale voltages using the reference voltage.

In accordance with an exemplary embodiment of the present invention, an apparatus for providing grayscale voltages is provided, which includes a reference voltage selector having a first node to which an original reference voltage is applied and a second node to which an initial reference voltage is applied, and outputs the original reference voltage or the initial reference voltage as a reference voltage in accordance with a selection signal. A voltage divider generates original grayscale voltages using the reference voltage. A grayscale voltage selector outputs grayscale voltages using the original grayscale voltages and a grayscale selection signal.

In accordance with an exemplary embodiment of the present invention, a method of enhancing picture quality of a display device having data lines driven by a data driver responsive to grayscale voltages divided from a reference voltage is provided. A first reference voltage having a first reference voltage rise time is provided. A second reference voltage having a second reference voltage rise time is provided, the second reference voltage rise time being longer than the first reference voltage rise time. The first reference voltage is selected to be the reference voltage prior to a scan start of a first frame being applied to the data lines. The second reference voltage is selected to be the reference voltage after the scan start of the first frame. A coupled stabilization capacitor may provide for the second reference voltage rise time being longer than the first reference voltage rise time.

DETAILED DESCRIPTION OF THE EMBODIMENTS

Figure 1:
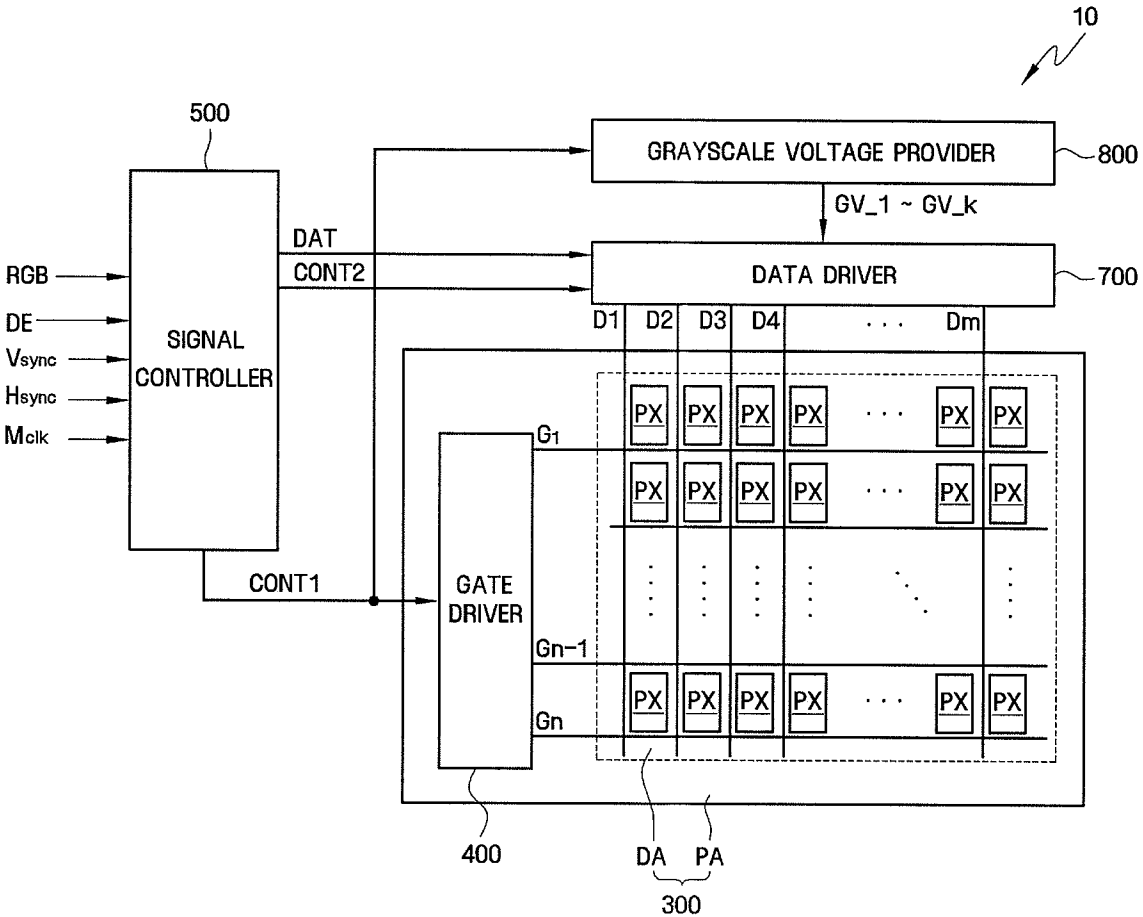
FIG. 1 is a block diagram depicting a display device in accordance with exemplary embodiments of the present invention.
Figure 2:
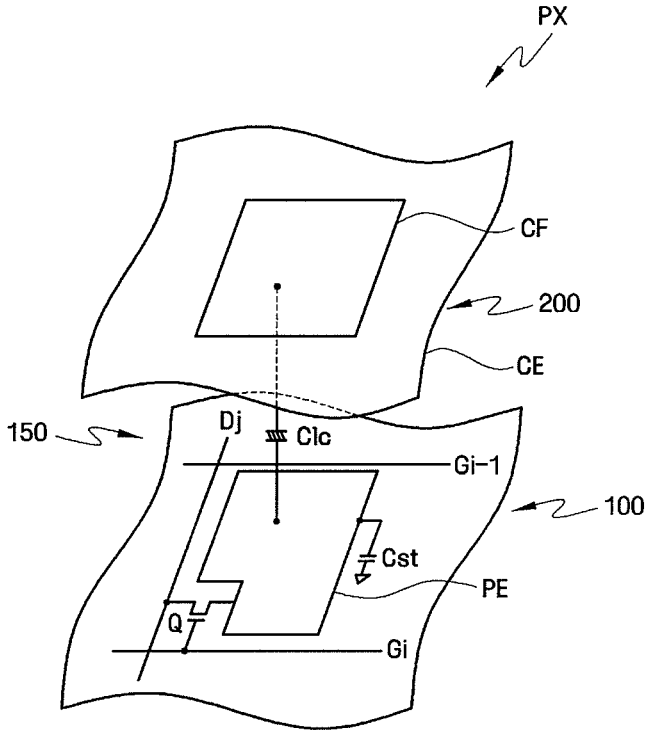
FIG. 2 is an equivalent circuit diagram of one pixel in FIG. 1.

Referring now to FIGS. 1 and 2, the display device 10 includes a display panel 300, a signal controller 500, a gate driver 400, a data driver 700, and a grayscale voltage provider 800.

The display panel 300 includes gate lines G1 . . . Gn-1, Gn, data lines D1, D2, D3, D4 . . . Dm, and pixels PX, and is divided into a display area DA where an image is displayed and a non-display area PA where no image is displayed.

An equivalent circuit of one pixel PX is illustrated in FIG. 2. A representative display area DA as seen in FIG. 2 includes a first substrate 100 having gate lines Gi, Gi-1, data line Dj, switching element Q, and a pixel electrode PE. A second substrate 200 has color filter CF and common electrode CE. A liquid crystal layer 150 is interposed between the first substrate 100 and the second substrate 200. The gate lines extend in a row direction and are substantially parallel to one another. The data line extends in a column direction and would substantially parallel to another adjacent data line (not shown). The non-display area PA would be that portion of the first substrate 100 which is wider than the second substrate 200.

On a part of the common electrode CE of the second substrate 200, the color filter CF faces the pixel electrode PE of the first substrate 100. For example, a pixel, which is connected to the i-th (where, i=1–n) gate line Gi and the j-th (where, j=1–m) data line Dj, includes the switching element Q connected to signal lines Gi and Dj, a liquid crystal capacitor Clc and a storage capacitor Cst connected to the switching element Q. The storage capacitor Cst may be omitted as needed. The switching element Q may be a thin film transistor composed of amorphous-silicon (hereinafter referred to as "a-Si TFT").

Referring back to FIG. 1, the signal controller 500 receives an original image signal RGB and an input control signal for controlling the display of the original image signal from an external graphic controller (not illustrated). The input control signal may include, for example, a vertical sync signal Vsync, a horizontal sync signal Hsync, a main clock signal Mclk and a data enable signal DE. The signal controller 500 generates an image signal DAT and a data control signal CONT2 on the basis of the original image signal RGB and the input control signal, and provides the image signal DAT and the data control signal CONT2 to the data driver 700. Also, the signal controller 500 generates a gate control signal CONT1 on the basis of the input control signal, and provides the gate control signal CONT1 to the gate driver 400.

The data control signal CONT2 is a signal for controlling the operation of the data driver 700, and may include a horizontal start signal STH for starting the operation of the data driver 700 and a load signal for instructing an output of the data voltage to the data lines D1, D2, D3, D4 . . . Dm. Also, the data control signal CONT2 may further include an inversion signal for inverting the polarity of the data voltage against a common data voltage Vcom (hereinafter, "the polarity of the data voltage against the common data voltage" is referred to as "the polarity of the data voltage").

The gate control signal CONT1 is a signal for controlling the operation of the gate driver 400, and may include a scan start signal STV for starting the operation of the gate driver 400 for each frame and at least one gate clock signal for controlling the output period of the gate-on voltage. Also, the gate control signal CONT1 may further include an output enable signal OE for adjusting the duration of the gate-on voltage.

The gate driver 400 receives the gate control signal CONT1 and a gate-off voltage Voff, and successively provides the gate-on voltage to the gate lines G1 . . . Gn-1, Gn. Specifically, the gate driver 400 is enabled in response to the scan start signal STV for each frame, and successively provides the gate-on voltage to the gate lines G1 . . . Gn, Gn in response to the gate clock signal.

The gate driver 400 may be formed on the non-display area PA of the display panel 300, and be connected to the display panel 300 as illustrated in the drawing. However, the gate driver 400 may also be mounted on a flexible printed circuit film as an integrated circuit (IC) and then attached to the display panel 300 in the form of a tape carrier package (TCP) or chip on film (COF), or may be mounted on a separate printed circuit board. Although it is illustrated in the drawing that the gate driver 400 is arranged only on one side of the display panel 300, a first gate driver and a second gate driver may be arranged on both sides of the display panel 300 as the gate driver 400.

Figure 3:
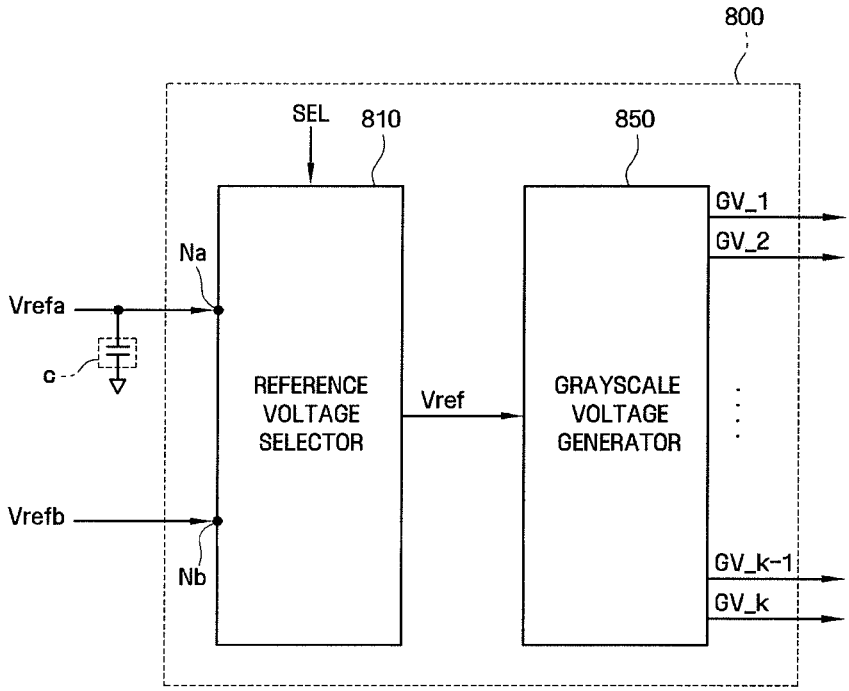
FIG. 3 is a block diagram depicting a grayscale voltage provider of FIG. 1.
Figure 4A:
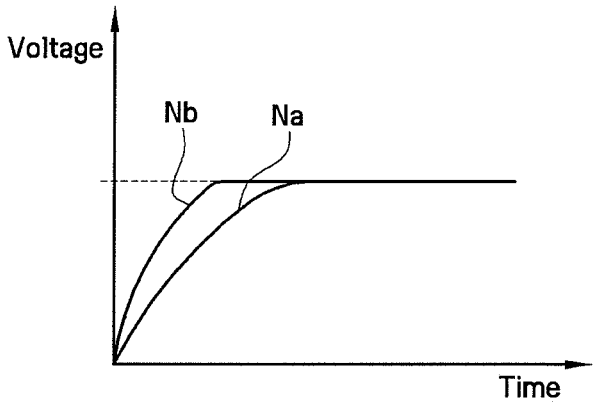
FIG. 4*a* is a graph depicting the voltage change of first and second nodes in a reference voltage selector of FIG. 3.
Figure 4B:
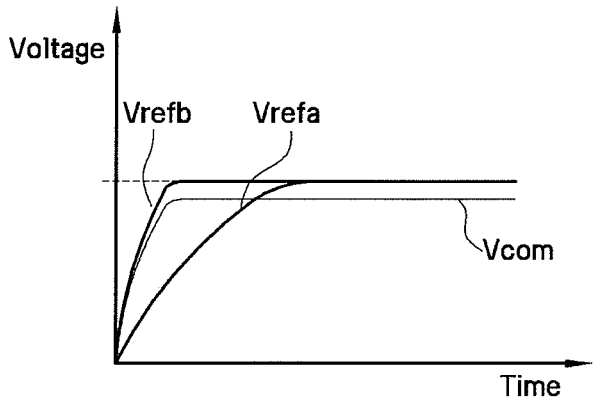
FIG. 4*b* is a graph depicting the voltage change of a data line in the case where a grayscale voltage provider uses first and second reference voltages.
Figure 5:
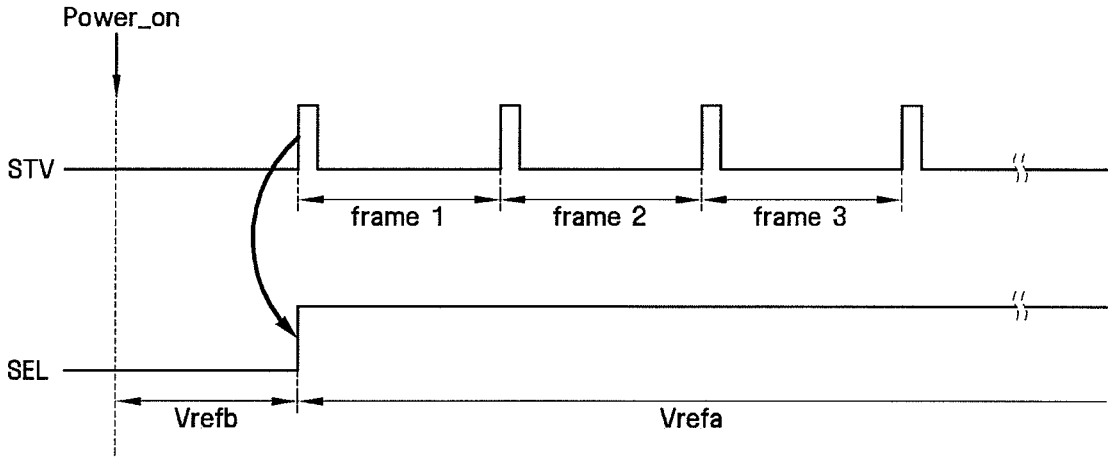
FIG. 5 is a graph depicting the operation of a reference voltage selector of FIG. 3.

FIG. 3 is a block diagram depicting the grayscale voltage provider 800 of FIG. 1. FIG. 4*a* is a graph depicting the voltage change of first and second nodes in the reference voltage selector 810 of FIG. 3, and FIG. 4*b* is a graph depicting the voltage change of a data line in the case where a grayscale voltage provider 800 uses first and second reference voltages. FIG. 5 is a graph depicting the operation of a reference voltage selector 810 of FIG. 3. FIG. 4*a* illustrates that the first reference voltage and the second reference voltage have the same voltage level, and the first and second nodes are charged with the same voltage level. FIG. 4*b* illustrates that the common data voltage has a voltage level that is lower than that of the first and second reference voltages. However, the common data voltage may be set to be higher than the first and second reference voltages.

Referring now to FIG. 3, the grayscale voltage provider 800 provides grayscale voltages GV_1, GV_2 . . . GV_k-1, GV_k using a first reference voltage Vrefa and a second reference voltage Vrefb in accordance with a selection signal SEL, and includes a reference voltage selector 810 and a grayscale voltage generator 850. The grayscale voltage provider 800 may be mounted on a flexible printed circuit film as an IC and then attached to the display panel 300 in the form of a tape carrier package (TCP) or chip on film (COF), or may be mounted on a separate printed circuit board.

The reference voltage selector 810 includes a first node Na to which the first reference voltage Vrefa is applied, and a second node Nb to which the second reference voltage Vrefb is applied, and outputs the first reference voltage Vrefa or the second reference voltage Vrefb as the reference voltage Vref in accordance with the selection signal SEL. Specifically, the reference voltage selector 810 provides the second reference signal Vrefb applied to the second node Nb as the reference voltage Vref for a specified time after the display device 10 is powered on in accordance with the selection signal SEL, and thereafter, provides the first reference voltage Vrefa applied to the first node Na as the reference voltage Vref.

In order to provide the first reference voltage Vrefa to the reference voltage selector 810 more stably, the first node Na may be coupled to a stabilization capacitor C. The stabilization capacitor C, as illustrated in FIG. 3, may be located outside of the grayscale voltage provider 800. However, in the display device according to another embodiment of the present invention, the stabilization capacitor C may be located inside the grayscale voltage provider.

The grayscale voltage generator 850 generates grayscale voltages GV_1, GV_2 . . . GV_k-1, GV_k using the reference voltage Vref provided from the reference voltage selector 810. For example, the grayscale voltage generator 850 may generate the entire range of grayscale voltages or a limited number of grayscale voltages related to the transmittivity of the pixels. Also, the grayscale voltages GV_1, GV_2 . . . GV_k-1, GV_k generated by the grayscale voltage generator 850 may have a positive polarity and a negative polarity relative to a common data voltage Vcom. The grayscale voltage generator 850 will be described in more detail below with reference to FIGS. 6, 11, and 12.

In the grayscale voltage provider 800 according to the embodiments of the present invention, the stabilization capacitor C is coupled to the first node Na, and thus the first reference voltage Vrefa that is provided to the reference grayscale selector 810 through the first node Na is relatively stable with substantially no ripple as compared to the second reference voltage Vrefb provided to the reference grayscale selection unit 810 through the second node Nb. However, since the stabilization capacitor C is coupled to the first node Na, the first node may have a relatively low charge speed as compared to the second node Nb. Accordingly, in the case where the grayscale voltage provider 800 provides the grayscale voltages GV_1, GV_2 . . . GV_k-1, GV_k after the display device 10 is powered on, a difference in charge speed, at which the data lines D1, D2, D3, D4 . . . Dm are charged with the data voltage, may occur, depending on whether the first reference voltage Vrefa or the second reference voltage Vrefb is provided to the reference grayscale selector 810.

Specifically, as illustrated in FIG. 4*a*, if the first reference voltage Vrefa being applied to the first node Na and the second reference voltage Vrefb being applied to the second node Nb have the same voltage level, the speed of charging the first node Na, which is coupled to the stabilization capacitor C, at a specified voltage level may be lower than the speed of charging the second node Nb at the specified voltage level. Accordingly, as illustrated in FIG. 4*b*, the speed of charging the data lines D1, D2, D3, D4 . . . Dm with the data voltage in a case where the display device 10 is powered on, the grayscale voltages GV_1, GV_2 . . . GV_k-1, GV_k are generated using the first reference voltage Vrefa, and the data voltage is applied to the data lines D1, D2, D3, D4 . . . Dm using the generated grayscale voltages, may be lower than the speed of charging the data lines D1, D2, D3, D4 . . . Dm with the data voltage in a case where the grayscale voltages GV_1, GV_2 . . . GV_k-1, GV_k are generated using the second reference voltage Vrefb, and the data voltage is applied to the data lines D1, D2, D3, D4 . . . Dm using the generated grayscale voltages. In accordance with the first and second reference voltages Vrefa and Vrefb, the speed of charging the data lines D1, D2, D3, D4 . . . Dm may be substantially similar to the speed of charging the first and second nodes Na and Nb.

Accordingly, in the case of generating the grayscale voltage GV_1, GV_2 . . . GV_k-1, GV_k using the first reference voltage Vrefa that corresponds to the relatively low speed of charging the data lines D1, D2, D3, D4 . . . Dm, the inferiority of picture quality may occur due to a difference between the common data voltage Vcom applied to the common electrode CE of the pixel PS and the data voltage applied to the data lines D1, D2, D3, D4 . . . Dm after the power-on of the display device 10. For example, as illustrated in FIG. 4*b*, a voltage difference occurs between the common electrode CE and the data lines D1, D2, D3, D4 . . . Dm after the power-on of the display device, and this may cause an abnormally bright image to be displayed.

However, in the display device 10 according to the embodiments of the present invention, the grayscale voltages GV_1, GV_2 . . . GV_k-1, GV_k are provided using the second reference voltage Vrefb applied to the second node Nb for a specified time after the power-on of the display device 10, and thereafter, the grayscale voltages GV_1, GV_2 . . . GV_k-1, GV_k are provided using the first reference voltage Vrefa applied to the first node Na, so that the inferiority of picture quality of the display device 10 can be prevented from occurring.

Specifically, in the display device 10 according to the exemplary embodiments of the present invention, the grayscale voltages GV_1, GV_2 . . . GV_k-1, GV_k can be provided using the second reference voltage Vrefb applied to the second node Nb, to which no stabilization capacitor is coupled, for a specified time after the power-on of the display device 10. Accordingly, the speed of charging the data lines D1, D2, D3, D4 . . . Dm with the data voltage becomes relatively high, and thus the inferiority of picture quality due to the difference between the common data voltage Vcom applied to the common electrode CE and the data voltage applied to the data lines D1, D2, D3, D4 . . . Dm can be prevented from occurring. After the elapse of a specified time, the grayscale voltages GV_1, GV_2 . . . GV_k-1, GV_k can be provided using the first reference voltage Vrefa applied to the first node Na, to which the stabilization capacitor is coupled, in accordance with the selection signal SEL. Accordingly, a relatively stable data voltage can be provided to the data lines D1, D2, D3, D4 . . . Dm with substantially no ripple.

In the display device 10 according to the embodiments of the present invention, the scan start signal STV provided from the signal controller 500 to the gate driver 400 may be used as the selection signal SEL. Here, the scan start signal STV is a signal that is provided for each frame (e.g. frame 1) to enable the gate driver 400, and for each frame, the gate driver 400 successively provides the gate-on voltage to the gate lines G1 . . . Gn-1, Gn in response to the scan start signal STV.

Specifically, and referring to FIG. 5, in the display device 10 according to the embodiments of the present invention, the selection signal SEL may be generated using the scan start signal STV provided in the first frame after the power-on of the display device 10. Accordingly, before the scan start signal STV in the first frame is provided, the grayscale voltages GV_1, GV_2 . . . GV_k-1, GV_k are generated using the second reference voltage Vrefb, and the data voltage is provided to the data lines D1, D2, D3, D4 . . . Dm using the generated grayscale voltages. After the scan start signal in the first frame is provided, the grayscale voltages GV_1, GV_2 . . . GV_k-1, GV_k are generated using the first reference voltage Vrefa, and the data voltage is provided to the data lines D1, D2, D3, D4 . . . Dm using the generated grayscale voltages GV_1, GV_2 . . . GV_k-1, GV_k. That is, before the first frame, the grayscale voltages GV_1, GV_2 . . . GV_k-1, GV_k are generated using the second reference voltage Vrefb, which is somewhat relatively unstable, but can quickly charge the data lines D1, D2, D3, D4 . . . Dm, and after the first frame, the grayscale voltages GV_1, GV_2 . . . GV_k-1, GV_k are generated using the first reference voltage Vrefa that is relatively stable.

In the exemplary embodiment the selection signal SEL is generated using the scan start signal STV. However, alternatively, the selection signal SEL may be generated using a specified signal provided before an image corresponding to the first frame is displayed. The specified signal, for example, may be provided from a signal provider or the like, and as described above, the inferiority of picture quality due to the difference between voltages applied to the common electrode and the data lines after the power-on of the display device can be substantially reduced.

The data driver 700 receives the grayscale voltages GV_1, GV_2 . . . GV_k-1, GV_k, the image signal DAT, and the data control signal CONT2, and provides the data voltage corresponding to the image signal DAT to the respective data lines D1, D2, D3, D4 . . . Dm. Accordingly, the respective pixels PX of the display panel 300 can display the image in accordance with the difference between the data voltage applied to the pixel electrode PE of the first substrate 100 and the common data voltage Vcom applied to the common electrode CE of the second substrate 200. The data driver 700 may be mounted on a flexible printed circuit film as an IC and then attached to the display panel 300 in the form of a tape carrier package or chip on film (COF), or may be mounted on a separate printed circuit board. In another embodiment, the data driver 700 may be formed on the non-display area PA of the display panel 300.

Figure 6:
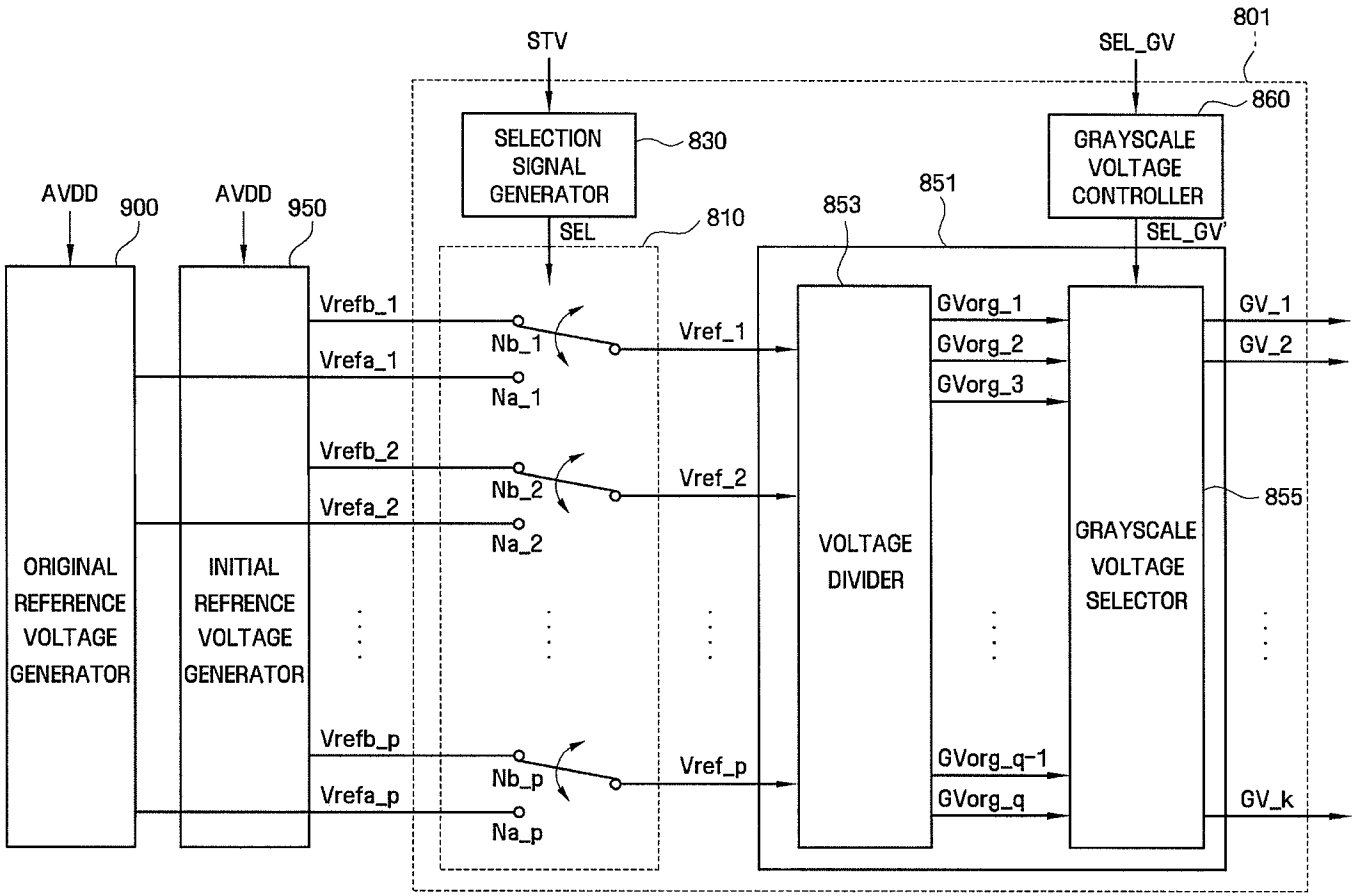
FIG. 6 is a block diagram depicting a display device according to an exemplary embodiment of the present invention.
Figure 7:
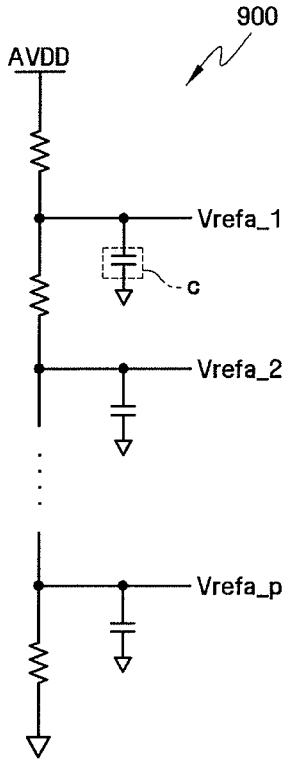
FIG. 7 is a circuit diagram depicting the original reference voltage generator of FIG. 6.
Figure 8:
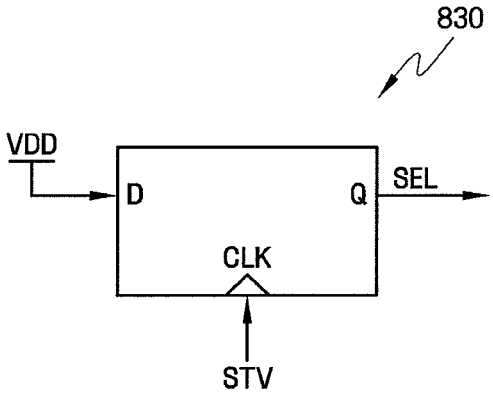
FIG. 8 is a circuit diagram depicting the selection signal generator of FIG. 6.
Figure 9:
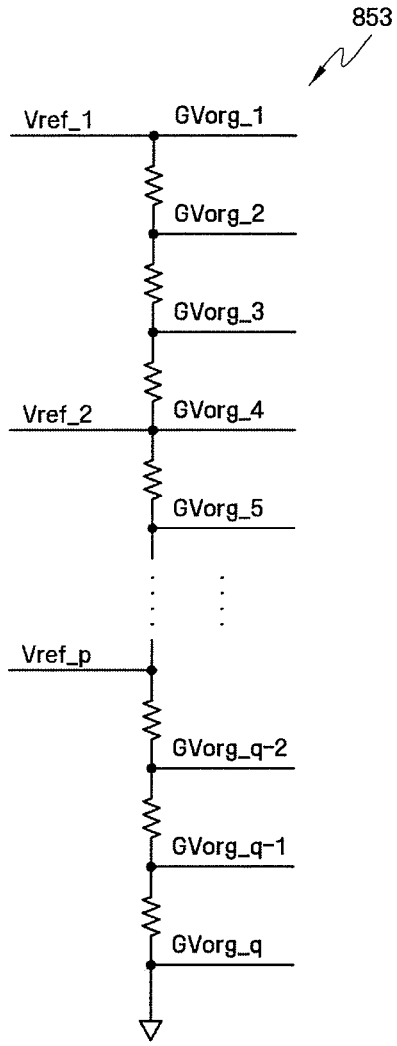
FIG. 9 is a circuit diagram depicting the voltage divider of FIG. 6.
Figure 10:
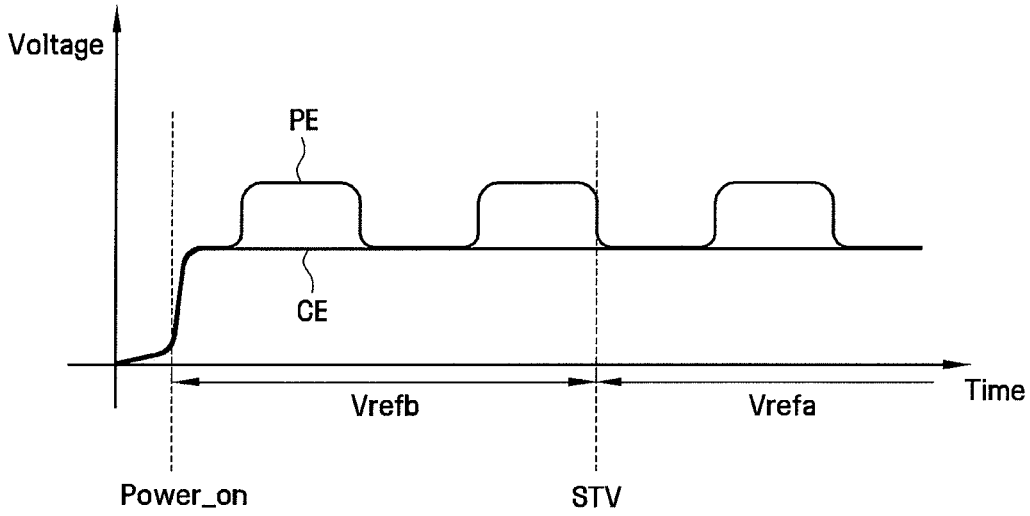
FIG. 10 is a graph depicting the operation of a display device according to an exemplary embodiment of the present invention.

FIG. 6 is a block diagram depicting a display device according to an exemplary embodiment of the present invention. FIG. 7 is a circuit diagram depicting an original reference voltage generator of FIG. 6. FIG. 8 is a circuit diagram depicting a selection signal generator of FIG. 6. FIG. 9 is a circuit diagram depicting a voltage divider of FIG. 6. FIG. 10 is a graph depicting the operation of a display device according to an embodiment of the present invention. For depiction simplification, circuits neighboring the grayscale voltage provider are illustrated in FIG. 6 with the omission of the signal controller, gate driver, data driver, and display panel of FIG. 1.

Referring to FIGS. 1 and 6 to 10, the display device includes a display panel 300, a signal controller 500, a gate driver 400, a data driver 700, an original reference voltage generator 900, an initial reference voltage generator 950, and a grayscale voltage provider 801. Since the display panel 300, the signal controller 500, the gate driver 400, and the data driver 700 have been described in detail with reference to FIG. 1, the detailed description thereof will be omitted.

The original reference voltage generator 900 receives a drive voltage AVDD, generates and outputs original reference voltages Vrefa_1, Vrefa_2 . . . Vrefa_p to original reference voltage output nodes. Here, the original reference voltages Vrefa_1, Vrefa_2 . . . Vrefa_p provided from the original reference voltage generator 900 may be applied to the first node Na of the reference voltage selector 810.

As illustrated in FIG. 7, the original reference voltage generator 900, for example, may include a column of resistors connected in the form of a cascade. Specifically, the original reference voltage generator 900 divides the provided drive voltage AVDD using the plurality of resistors, and outputs the divided voltages to the respective original reference voltage output nodes as the original reference voltages Vrefa_1 Vrefa_2 . . . Vrefa_p. Also, since a stabilization capacitor C is coupled to each of the original reference voltage output nodes of the original reference voltage generator 900, the original reference voltages Vrefa_1, Vrefa_2 . . . Vrefa_p formed through the voltage division become relatively stable with substantially no ripple. Here, since the output nodes of the original reference voltage generator 900 are coupled to the first nodes Na_1, Na_2 . . . Na_p of the reference voltage selector 810, respectively, the stabilization capacitor C of the original reference voltage generator 900 may be a stabilization capacitor coupled to the first node Na of the reference voltage selector 810 as illustrated in FIG. 3.

The initial reference voltage generator 950 receives the drive voltage AVDD, generates and outputs initial reference voltages Vrefb_1, Vrefb_2 . . . Vrefb_p to initial reference voltage output nodes. Here, the initial reference voltages Vrefb_1, Vrefb_2 . . . Vrefb_p may be applied to the second nodes Nb of the reference voltage selector 810. Much like the column of resistors illustrated in FIG. 7, the initial reference voltage generator 950 may include a column of resistors connected in the form of a cascade. In the case where the drive voltage AVDD and the resistor column are configured in the same form as those of the original reference voltage generator 900, the initial reference voltages Vrefb_1, Vrefb_2 . . . Vrefb_p generated by the initial reference voltage generator 950 may have the same voltage level as that of the original reference voltages Vrefa_1, Vrefa_2 . . . Vrefa_p generated by the original reference voltage generator 900. However, unlike the original reference voltage generator 900, each output node of the initial reference voltage generator 950 would not be coupled to the stabilization capacitor C. Accordingly, even if the original reference voltages Vrefa_1, Vrefa_2 . . . Vrefa_p and the initial reference voltages Vrefb_1, Vrefb_2 . . . Vrefb_p, which have the same voltage level, are applied to the first and second nodes Na and Nb of the reference voltage selector 810, respectively, the speed of charging the first node Na at a specified level may be lower than the speed of charging the second node Nb at the specified level.

The grayscale voltage provider 801 generates the grayscale voltages GV_1, GV_2 . . . GV_k-1, GV_k using the original reference voltages Vrefa_1, Vrefa_2 . . . Vrefa_p or the initial reference voltages Vrefb_1, VrefB_2 . . . Vrefb_p in accordance with the selection signal SEL, and includes a selection signal generator 830, a reference signal selector 810, a grayscale voltage generator 851, and a grayscale voltage controller 860. Here, the number of grayscale voltages GV_1, GV_2 . . . GV_k-1, GV_k may be larger than the number of original reference voltages Vrefa_1, Vrefa_2 . . . Vrefa_p or initial reference voltages Vrefb_1, Vrefb_2 . . . Vrefb_p.

The selection signal generator 830 generates the selection signal using the scan start signal STV. Specifically, the selection signal generator 830 may generate the selection signal in response to the scan start signal STV in the first frame after the power-on of the display device 10. As illustrated in FIG. 8, the selection signal generator 830 may include a flip-flop receiving a specified constant voltage VDD and outputting the selection signal SEL in response to the scan start signal STV. However, it would be apparent to those skilled in the art that the selection signal generator can be configured in diverse circuits.

The reference voltage selector 810 includes the first node Na to which the original reference voltages Vrefa_1, Vrefa_2 . . . Vrefa_p is applied and the second node Nb to which the initial reference voltages Vrefb_1, Vrefb_2 . . . Vrefb_p is applied, and outputs the original reference voltages Vrefa_1, Vrefa_2 . . . Vrefa_p or the initial reference voltages Vrefb_1, Vrefb_2 . . . Vrefb_p as the reference voltages Vref_1, Vref_2 . . . Vref_p in accordance with the selection signal SEL. Specifically, the reference voltage selector 810 provides the initial reference voltages Vrefb_1, Vrefb_2 . . . Vrefb_p applied to the second node Nb as the reference voltages Vref_1, Vref_2 . . . Vref_p for a specified time after the power-on of the display device in accordance with the selection signal SEL, and thereafter, provides the original reference voltages Vrefa_1, Vrefa_2 . . . Vrefa_p applied to the first node Na as the reference voltages Vref_1, Vref_2 . . . Vref_p.

The grayscale voltage generator 851 generates the grayscale voltages GV_1, GV_2 . . . GV_k-1, GV_k using the reference voltages Vref_1, Vref_2 . . . Vref_p provided from the reference voltage selector 810, and includes a voltage divider 853 and a grayscale voltage selector 855.

The voltage divider 853 receives the reference voltages Vref_1, Vref_2 . . . Vref_p, generates and provides the original grayscale voltages GVorg_1, GVorg_2, GVorg_3 . . . GVorg_q−1, GVorg_q to the grayscale voltage selector 855. The voltage divider 853, as illustrated in FIG. 9, may include a column of a plurality of resistors connected in the form of a cascade. Here, the number of original grayscale voltages GVorg_1, GVorg_2, GVorg_3 . . . GVorg_q-1, GVorg_q may be larger than the number of grayscale voltages GV_1, GV_2 . . . GV_k-1, GV_k.

The grayscale voltage selector 855 selectively outputs the grayscale voltages GV_1, GV_2 . . . GV_k-1, GV_k using the original grayscale voltage GVorg_1, GVorg_2, GVorg_3 . . . GVorg_q-1, GVorg_q and a grayscale selection signal SEL_GV'. Specifically, the grayscale voltage selector 855 selects and outputs a part of the original grayscale voltages GVorg_1, GVorg_2, GVorg_3 . . . GVorg_q-1, GVorg_q as the grayscale voltages GV_1, GV_2 . . . GV_k-1, GV_k in accordance with the grayscale selection signal SEL_GV' so that the output grayscale voltages GV_1, GV_2 . . . GV_k-1, GV_k correspond to specified gamma coefficients of an image being displayed on the display device.

The grayscale voltage selection unit 855 may be composed of a multiplexer MUX receiving all the original grayscale voltages GVorg_1, GVorg_2, GVorg_3 . . . GVorg_q-1, GVorg_q and outputting all the grayscale voltages GV_1, GV_2 . . . GV_k-1, GV_k in response to the grayscale selection signal SEL_GV', or may be composed of a plurality of multiplexers receiving a part of the original grayscale voltages GVorg_1, GVorg_2, GVorg_3 . . . GVorg_q-1, GVorg_q and outputting a part of the grayscale voltages GV_1, GV_2 . . . GV_k-1, GV_k in response to the grayscale selection signal SEL_GV'.

The grayscale voltage controller 860 receives grayscale information SEL_GV from the signal controller 500 and generates the grayscale selection signal SEL_GV'. Specifically, the grayscale voltage controller 860 includes a lookup table that stores grayscale voltage information corresponding to the grayscale information SEL_GV, and thus can generate the grayscale selection signal SEL_GV' in accordance with the grayscale information SEL_GV.

That is, in the display device according to an exemplary embodiment of the present invention, before the scan start signal STV in the first frame is provided after the power-on of the display device, the grayscale voltages GV_1, GV_2 . . . GV_k-1, GV_k are generated using the initial reference voltages Vrefb_1, Vrefb_2 . . . Vrefb_p, and the data voltage is provided to the data lines D1, D2, D3, D4 . . . Dm using the generated grayscale voltages. After the scan start signal STV in the first frame is provided, the grayscale voltages GV_1, GV_2 . . . GV_k-1, GV_k are generated using the original reference voltages Vrefa_1, Vrefa_2 . . . Vrefa_p, and the data voltage is provided to the data lines D1, D2, D3, D4 . . . Dm using the generated grayscale voltages GV_1 GV_2 . . . GV_k-1, GV_k. Accordingly, as illustrated in FIG. 10, before an image corresponding to the first frame is displayed after the power-on of the display device, the difference between the common data voltage Vcom applied to the common electrode CE and the data voltage applied to the data lines D1, D2, D3, D4 . . . Dm can be substantially prevented from occurring. Accordingly, the inferiority of picture quality of the display device due to the difference between the voltage applied to the common electrode CE and the voltage applied to the data lines D1, D2, D3, D4 . . . Dm can be substantially prevented from occurring. Also, after the first frame, the grayscale voltages GV_1, GV_2 . . . GV_k-1, GV_k are provided using the relatively stable original reference voltages Vrefa_1, Vrefa_2 . . . Vrefa_p with substantially no ripple through the stabilization capacitor C, and thus the stable data voltage with substantially no ripple can be provided to the data lines D1, D2, D3, D4 . . . Dm.

Figure 11:
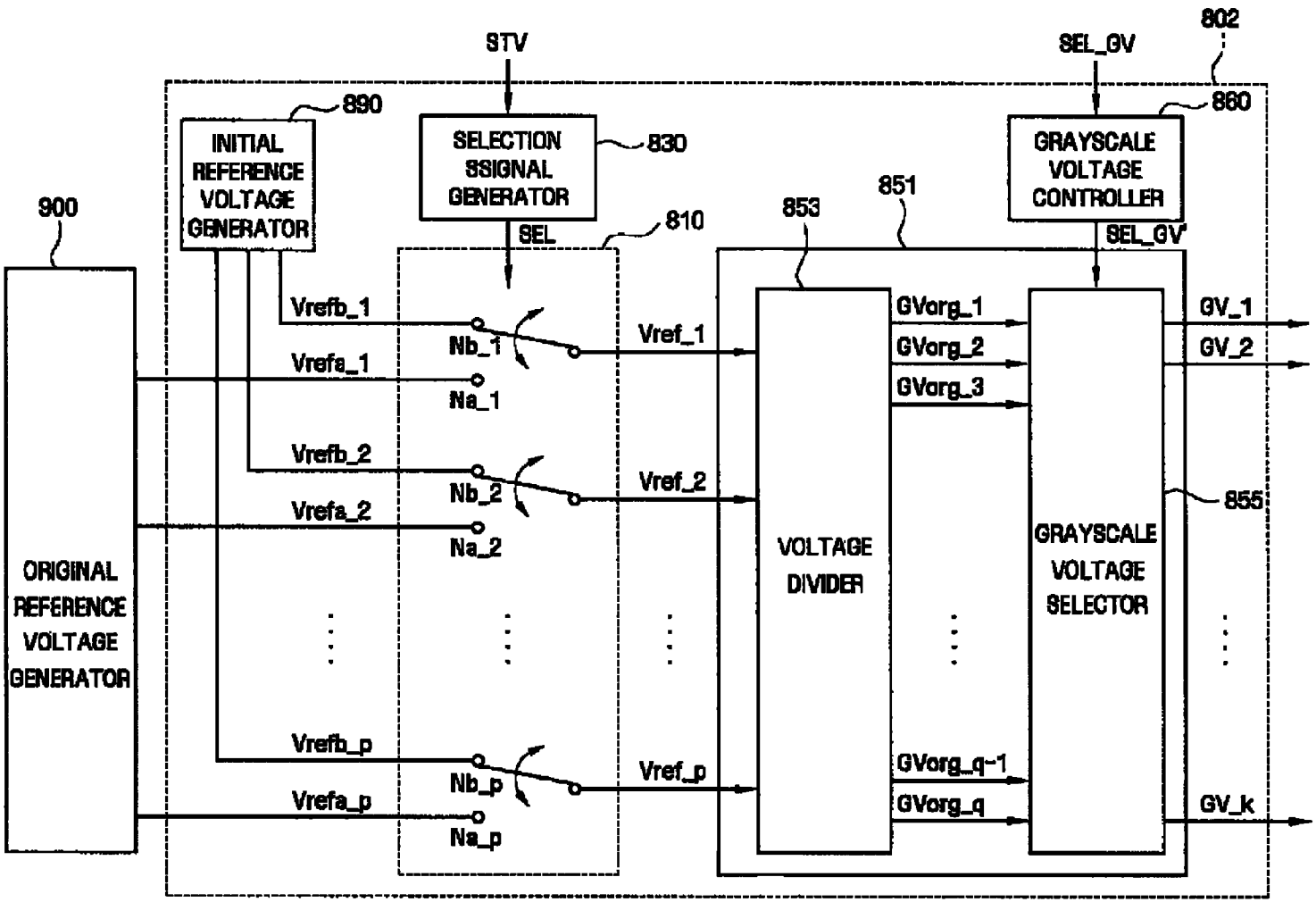
FIG. 11 is a block diagram depicting a display device according to an exemplary embodiment of the present invention.

FIG. 11 is a block diagram depicting a display device according to an exemplary embodiment of the present invention. For depiction simplification, circuits neighboring the grayscale voltage provider are illustrated in FIG. 11 with the omission of the signal controller, gate driver, data driver, and display panel of FIG. 1.

Referring to FIGS. 6 and 11, the initial reference voltage generator 890 is located inside the grayscale voltage provider 802, unlike the display device according to the previous exemplary embodiment. Specifically, since the grayscale voltage provider 802 of the display device includes the initial reference voltage generator 890 provided therein, it can be driven by one drive voltage AVDD instead of a plurality of initial reference voltages Vrefb_1, Vrefb_2 . . . Vrefb_p. Accordingly, in the case where the grayscale voltage provider 802 is constructed as one IC, the number of input pins for inputting voltages to the IC can be reduced.

Figure 12:
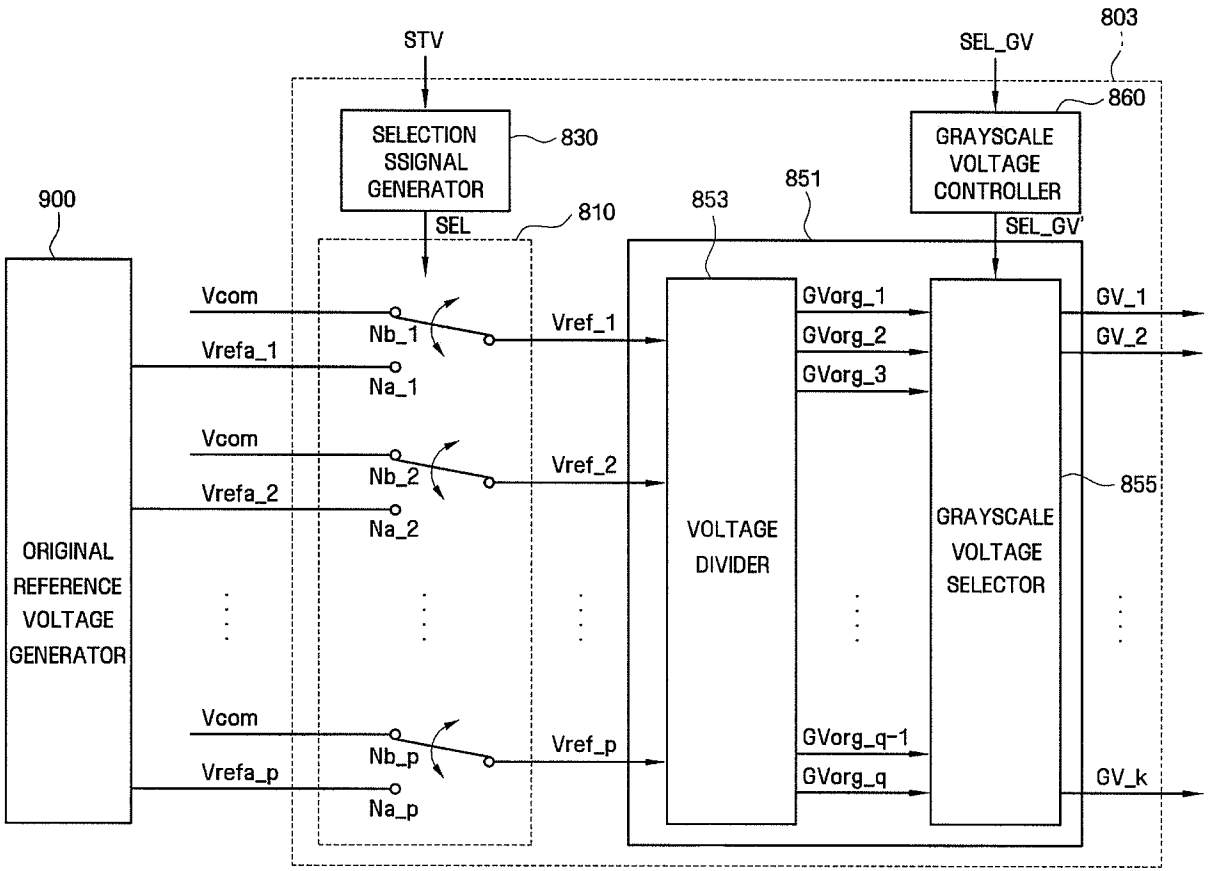
FIG. 12 is a block diagram depicting a display device according to an exemplary embodiment of the present invention.
Figure 13:
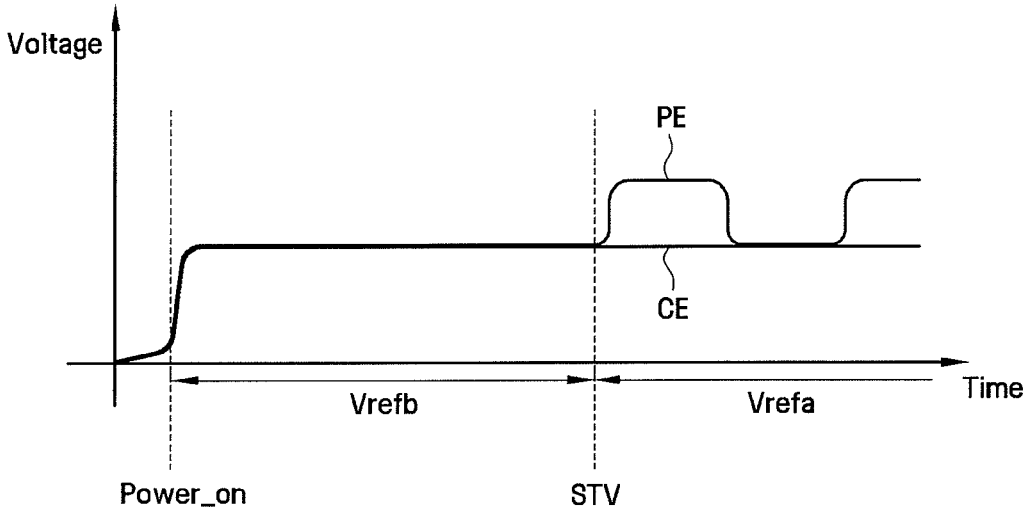
FIG. 13 is a graph depicting the operation of a display device according to an exemplary embodiment of the present invention.

FIG. 12 is a block diagram depicting a display device according to an exemplary embodiment of the present invention, and FIG. 13 is a graph depicting the operation of the display device. For depiction simplification, circuits neighboring the grayscale voltage provider are illustrated in FIG. 12 with the omission of the signal controller, gate driver, data driver and display panel of FIG. 1.

Referring to FIGS. 6, 12, and 13, the display device does not include the initial reference signal generator 950, unlike the display device according to a previous embodiment.

Specifically, the original reference voltages Vrefa_1, Vrefa_2 . . . Vrefa_p are provided to the first node Na of the reference voltage selector included in the grayscale voltage provider 803, and the common data voltage Vcom is provided to the second node Nb. That is, before the scan start signal STV in the first frame is provided after the power-on of the display device, the grayscale voltages GV_1, GV_2 . . . GV_k-1, GV_k are generated using the common data voltage Vcom, and the data voltage is provided to the data lines D1, D2, D3, D4 . . . Dm using the generated grayscale voltages. After the scan start signal STV in the first frame is provided, the grayscale voltages GV_1, GV_2 . . . GV_k-1, GV_k are generated using the original reference voltages Vrefa_1, Vrefa_2 . . . Vrefa_p, and the data voltage is provided to the data lines D1, D2, D3, D4 . . . Dm using the generated grayscale voltages GV_1, GV_2 . . . GV_k-1, GV_k.

Accordingly, as illustrated in FIG. 13, before an image corresponding to the first frame is displayed after the power-on of the display device, the difference between the common data voltage Vcom applied to the common electrode CE and the data voltage applied to the data lines D1, D2, D3, D4 . . . Dm can be substantially prevented from occurring. That is, the voltage level of the data lines D1, D2, D3, D4 . . . Dm may substantially be equal to the voltage level of the common electrode CE. As such, the inferiority of picture quality of the display device due to the difference between the voltage applied to the common electrode CE and the voltage applied to the data lines D1, D2, D3, D4 . . . Dm can be substantially prevented from occurring. Also, after the first frame, the grayscale voltages GV_1, GV_2 . . . GV_k-1, GV_k are provided using the relatively stable original reference voltages Vrefa_1, Vrefa_2 . . . Vrefa_p with substantially no ripple through the stabilization capacitor C, and thus the stable data voltage with substantially no ripple can be provided to the data lines D1, D2, D3, D4 . . . Dm.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A display device having gate lines and data lines comprising:

a grayscale voltage provider that provides grayscale voltages using a first reference voltage and a second reference voltage in accordance with a selection signal;

a data driver that applies data voltages to the data lines using the grayscale voltages and an image signal;

a gate driver that successively provides a gate-on voltage to the gate lines; and a display panel that displays an image for each frame using the data voltages and the gate-on voltage, wherein the grayscale voltage provider comprises a reference voltage selector having a first node to which the first reference voltage is applied and a second node to which the second reference voltage is applied, wherein a stabilization capacitor is coupled to the first node such that the first node is chargeable at a lower rate than the second node, and wherein the grayscale voltage provider in response the selection signal outputs the second reference voltage as a reference voltage for a specified time after the display device is powered on based upon a capacitance of the stabilization capacitor, followed by the first reference voltage as the reference voltage after the specified time.

2. The display device of claim 1, wherein:

the gate driver successively provides the gate-on voltage to the gate lines in response to a scan start signal for each frame, and the selection signal is generated using the scan start signal.

3. The display device of claim 2, wherein:

the grayscale voltage provider comprises a selection signal generator that generates the selection signal using the scan start signal, and the selection signal is generated using the scan start signal provided from a first frame among the frames.

4. The display device of claim 2, wherein the grayscale voltage provider:

provides grayscale voltages using the second reference voltage before the first frame among the frames, and provides the grayscale voltages using the first reference voltage after the first frame.

5. The display device of claim 1, wherein:

the display panel displays the image in accordance with a difference in voltage level between a data voltage provided to the data lines and a common data voltage, and before the first frame among the frames after a power-on of the display device, a voltage level of the data lines is equal to a voltage level of the common data voltage.

6. The display device of claim 1, wherein the grayscale voltage provider comprises:

a grayscale voltage generator that generates the grayscale voltages using the reference voltage.

7. The display device of claim 6, wherein the stabilization capacitor is coupled to the first node so that a first capacitance coupled to the first node is larger than a second capacitance coupled to the second node.

8. The display device of claim 6, further comprising:

an original reference voltage generator that receives a drive voltage and outputs original reference voltages through original reference voltage output nodes to which stabilization capacitors are coupled; and an initial reference voltage generator that receives the drive voltage and outputs initial voltages through initial voltage output nodes; and wherein the first reference voltage is the original reference voltage, and the second reference voltage is the initial reference voltage.

9. The display device of claim 6, wherein:

the display panel displays the image in accordance with a difference in voltage level between the data voltage provided to the data lines and a common data voltage, the first reference voltage being applied to the first node is the original reference voltage, and the second reference voltage being applied to the second node is the common data voltage.

10. The display device of claim 6, wherein the grayscale voltage generator comprises:

a voltage divider that generates original grayscale voltages using the reference voltage; and a grayscale voltage selector that outputs the grayscale voltages using the original grayscale voltages and a grayscale selection signal.

11. An apparatus for providing grayscale voltages, comprising:

a reference voltage selector having a first node to which a first reference voltage is applied and a second node to which a second reference voltage that has a voltage level different from that of the first reference voltage is applied, and that outputs the first reference voltage or the second reference voltage as a reference voltage in accordance with a selection signal; and a grayscale voltage generator that generates grayscale voltages using the reference voltage, wherein a stabilization capacitor is coupled to the first node such that the first node is chargeable at a lower rate than the second node, and wherein the reference voltage selector in response to a reference voltage selection signal outputs the second reference voltage as a reference voltage for a specified time after the display device is powered on based upon a capacitance of the stabilization capacitor, followed by the first reference voltage as the reference voltage after the specified time.

12. The apparatus of claim 11, further comprising a selection signal generator that generates the selection signal using a scan start signal;

wherein the grayscale voltage generator comprises:

a voltage divider that generates original grayscale voltages using the reference voltage; and a grayscale voltage selector that outputs the grayscale voltages using the original grayscale voltages and a grayscale selection signal.

13. An apparatus for providing grayscale voltages, comprising:

a reference voltage selector having a first node to which an original reference voltage is applied and a second node to which an initial reference voltage is applied, and that outputs the original reference voltage or the initial reference voltage as a reference voltage in accordance with a selection signal;

a voltage divider that generates original grayscale voltages using the reference voltage; and a grayscale voltage selector that outputs grayscale voltages using the original grayscale voltages and a grayscale selection signal, wherein a stabilization capacitor is coupled to the first node such that the first node is chargeable at a lower rate than the second node, and wherein the reference voltage selector in response the selection signal outputs the second reference voltage as a reference voltage for a specified time after the display device is powered on based upon a capacitance of the stabilization capacitor, followed by the first reference voltage as the reference voltage after the specified time.

14. The apparatus of claim 13, further comprising an initial voltage generator that receives a drive voltage and that generates the initial reference voltage.

15. The apparatus of claim 13, wherein a speed of charging the first node is lower than a speed of charging the second node.

16. The apparatus of claim 13, further comprising a selection signal generator, coupled to the reference voltage selector, that generates the grayscale selection signal using a scan start signal.

17. A method of enhancing picture quality of a display device having data lines driven by a data driver responsive to grayscale voltages divided from a reference voltage, the method comprising:

providing to a second node a second reference voltage having a second reference voltage rise time;

coupling a stabilization capacitor to a first node and providing to the first node a first reference voltage having a first reference voltage rise time, the first reference voltage rise time being longer than the second reference voltage rise time;

selecting the second reference voltage to be the reference voltage prior to a scan start of a first frame being applied to the data lines; and selecting the first reference voltage to be the reference voltage after the scan start of the first frame, wherein in response to the selecting the second reference voltage is output as a reference voltage for a specified time after the display device is powered on based upon a capacitance of the stabilization capacitor, followed by the first reference voltage as the reference voltage after the specified time.

18. The method of claim 17, wherein a coupled stabilization capacitor provides for the first reference voltage rise time being longer than the second reference voltage rise time.

* * * * *